US006421971B1

(12) United States Patent
Gembala

(10) Patent No.: US 6,421,971 B1
(45) Date of Patent: Jul. 23, 2002

(54) EDGE CLOSURE WITH CANT FOR ROOF SYSTEMS

(76) Inventor: Henry Gembala, 18108 Clearbrook Cir., Boca Raton, FL (US) 33498

( * ) Notice: Subject to any disclaimer, the term of this patent is extended or adjusted under 35 U.S.C. 154(b) by 0 days.

(21) Appl. No.: 09/693,330

(22) Filed: Oct. 20, 2000

Related U.S. Application Data

(62) Division of application No. 09/177,846, filed on Oct. 22, 1998, now Pat. No. 6,237,293.

(51) Int. Cl.[7] ..... E04B 1/70

(52) U.S. Cl. ..... 52/302.6; 52/59; 52/95; 52/96

(58) Field of Search ..... 52/302.1, 302.3, 52/302.6, 95–97, 58, 40, 62, 101, 59, 407–410, 413, 383

(56) References Cited

U.S. PATENT DOCUMENTS 4,071,987 A * 2/1978 Hickman ..... 52/94
4,995,308 A * 2/1991 Waggoner ..... 98/37
5,272,846 A * 12/1993 Kelley et al. ..... 52/96
5,328,406 A * 7/1994 Morris, Jr. et al. ..... 454/260
5,927,023 A * 7/1999 Kittilstad ..... 52/60
6,101,767 A * 8/2000 Georgeau ..... 52/62
6,237,293 B1 * 5/2001 Gembala ..... 52/302.6

* cited by examiner

*Primary Examiner*—Carl D. Friedman
*Assistant Examiner*—Yvonne M. Horton
(74) *Attorney, Agent, or Firm*—Robert M. Downey, P.A.

(57) ABSTRACT

An integral, pre-formed edge closure fabricated from a non-corrosive, durable material includes an anchoring flange for attachment to a roof structure, an upper flange, an intermediate panel spanning between the anchoring flange and the upper flange, a cant panel positioned at an acute angle relative to the upper flange to define a cant strip along a length of the edge closure, and a mounting strip above the cant panel for securing the edge closure to a concrete parapet or other adjoining vertical wall on a roof structure. The anchoring flange and upper flange are spaced apart for receiving a thickness of insulation of lightweight concrete therebetween. The intermediate panel is provided with vent holes for venting gasses and moisture which accumulate within the roof structure, thereby reducing the likelihood of premature roof failure.

18 Claims, 1 Drawing Sheet

EDGE CLOSURE WITH CANT FOR ROOF SYSTEMS

This application is a divisional patent application of patent application Ser. No. 09/177,846 filed Oct. 22, 1998, now U.S. Pat. No. 6,237,293 B1.

BACKGROUND OF THE INVENTION

1. Field of the Invention

The present invention relates to blocking for use in roof systems and, more particularly, to a combined edge closure and cant strip formed as one-piece from a non-corrosive, durable material, such as galvanized steel, steel, aluminum or plastic and including a lower anchoring flange for attachment to the roof structure, a central portion including vent means formed therein, an upper flange, and a cant strip angled upwardly from the upper flange.

2. Description of the Related Art

Generally, roof systems used on most building structures, and particularly commercial buildings, require some type of blocking to provide a base for the attachment of roofing components such as, but not limited to, gravel stops, eves, drips, fascia, gutters, vent stacks, roof top equipment, expansion joints, roof curbs, copings and cant strips. Traditionally, wood is used for roof blocking and typically consists of one or more stacked wood boards (e.g., 2 inch by 4 inch or 2 inch by 6 inch boards) which are nailed to the roof structure and each other to provide a built-up base at various locations on the roof system wherein it is necessary to mount the roofing components and equipment. Presently, wood blocking is used on virtually all roof systems which require blocking for the purposes described above.

Despite its widespread use in roof systems, there are significant drawbacks and shortcomings associated with the use of conventional wood blocking. In particular, wood is susceptible to damage and deterioration from moisture, termites, ants, and other natural enemies. Further, because wood is a solid material, it does not provide for venting capabilities to permit escape of moisture and gasses from within the roof. The lack of adequate venting is a contributing factor of premature roof failure. Additionally, wood has limited pull-out characteristics for holding nails and other fasteners, thereby requiring a considerable amount of hardware to attach roofing components. Wood, being a natural product, is also prone to irregularities such as areas of reduced dimension, warping, and splintering. This makes it difficult, if not impossible, to achieve a straight, uniform blocking configuration. Furthermore, the dimensions of wood are limited to lumber industry standards which often does not correspond to the dimensions of roofing components, such as roof insulation or lightweight concrete thickness, expansion joint heights and equipment sizes.

In view of the shortcomings of traditional wood blocking used in roof systems, as set forth above, there exists an urgent need in the construction industry for an alternative blocking structure which overcomes the above-described problems. More specifically, there is a need for a combined edge closure and cant strip which provides for uniform dimensions in accordance with desired size and configuration specifications and which further provides for venting of the roof system. Additionally, there is a need for a one-piece, non-corrosive edge closure and cant strip which significantly reduces costs for labor and materials associated with the installation of a roof system.

SUMMARY OF THE INVENTION

The present invention is directed to a one-piece, integral structure formed from a non-corrosive material to replace traditional wood cant strips and edge closures which are currently used in roof systems of building structures.

The combined edge closure and cant strip is formed from a single sheet of non-corrosive material, such as galvanized steel, steel, aluminum or plastic and includes an anchoring flange, an upper flange, an intermediate panel, a cant panel and a mounting strip. The anchoring flange is structured and disposed for mating attachment to the roof structure underlying an insulation layer or lightweight concrete layer on the roof system. The intermediate panel extends upwardly from the anchoring flange to the upper flange, forming a gap or area of depth between the anchoring flange and upper flange. The gap is specifically adapted for receiving a predetermined thickness of insulation or lightweight concrete. The upper flange extends outwardly and generally perpendicular to the intermediate panel. The cant panel is angled inwardly and upwardly from the upper flange to a top mounting strip which is adapted to be secured to a concrete parapet or adjoining vertical wall on a roof structure. Vent means are provided in the intermediate panel to allow escape of moisture and gasses which otherwise remain trapped within the roof system. This helps to reduce the likelihood of premature roof failure, and thereby extends the life of the roof system.

OBJECTS AND ADVANTAGES OF THE INVENTION

With the foregoing in mind, the present invention has the following objects and advantages over the conventional wood blocking structures presently used in most roof systems.

It is a primary object of the present invention is to provide a blocking assembly for roof systems comprising one or more pre-formed components manufactured from galvanized steel, steel, aluminum, plastic or other corrosion-resistant materials to thereby provide resistance to deterioration from moisture, insects, warping, and the like.

It is a further object of the present invention to provide a blocking assembly comprising a one-piece structure forming a combined edge closure and cant for use in a roof system.

It is still a further object of the present invention to provide a blocking assembly having a pullout resistance which is significantly greater than that of wood, thereby requiring less hardware, labor and materials to install the blocking and attached roofing materials.

It is yet a further object of the present invention to provide a blocking assembly which is pre-formed and fabricated to conform to any roof insulation or lightweight concrete thickness requirements.

It is still a further object of the present invention to provide a blocking assembly for roof systems which includes venting means for allowing moisture and gasses to be released from the roof assembly, thereby reducing the likelihood of premature roof failure.

It is still a further object of the present invention to provide a blocking assembly for roof systems which is structured to encapsulate the edge of insulation and/or lightweight concrete.

It is yet a further object of the present invention to provide a blocking assembly having pre-punched fastener holes to thereby alleviate human error during installation.

It is still a further object of the present invention to provide a blocking assembly for roof systems which, once installed, becomes integrated with the roof structure.

It is still a further object of the present invention to provide a cant for roof construction which replaces traditional wood cants and which reduces the amount of materials needed in the construction of a roof system, thereby increasing efficiency of installation and reducing the overall cost of labor and materials.

It is still a further object of the present invention to provide a combined edge closure and cant for roof systems which replaces wood materials ordinarily used for such purposes and which is relatively inexpensive to manufacture.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
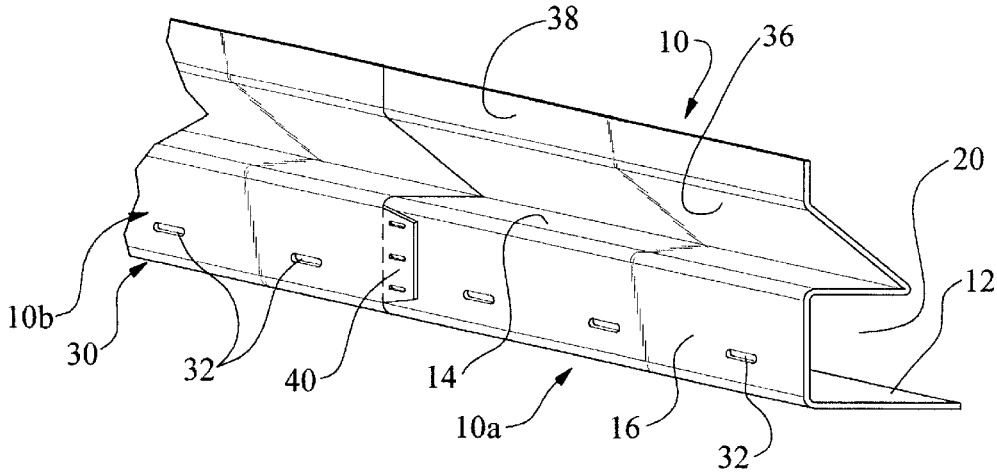
FIG. 1 is a partial perspective view of a preferred embodiment of the invention showing an edge closure, and an integral cant extending from the upper flange of the edge closure.
Figure 2:
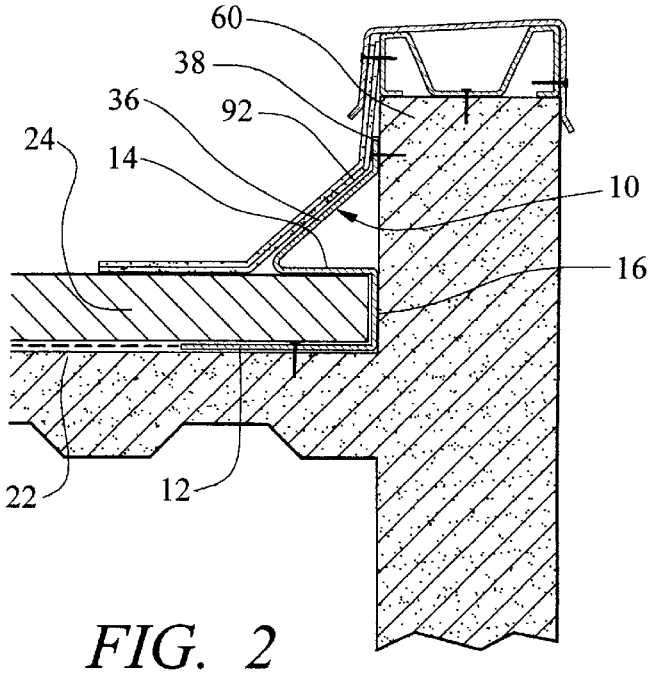
FIG. 2 is a sectional view showing the edge closure and cant installed to a roof slab and concrete parapet on a roof system to accommodate installation of insulation and a flashing strip.

Referring to FIGS. 1 and 2, the edge closure is shown and is generally indicated as 10. The edge closure 10 is formed as an integral unit and comprises an anchoring flange 12, an upper flange 14, an intermediate plate 16 extending between the anchoring flange 12 and upper flange 14, a cant panel 36 and a mounting strip 38.

The anchoring flange 12 and upper flange 14 extend generally perpendicularly from the intermediate plate in spaced, parallel relation to one another to form a gap or area of depth 20 therebetween. The anchoring flange 12 preferably extends further from the intermediate plate than the upper flange, providing a larger surface area for mating, anchoring attachment to the roof slab 22 of the roof structure. A drive anchor with removable pin may be used to secure the anchoring flange to the roof slab which is typically a concrete substrate. Alternatively, concrete nails or other well known anchoring hardware may be used for this purpose. The gap or area of depth 20 accommodates roof insulation or a lightweight insulative concrete layer 24 which is applied in covering relation to the underlying roof slab 22.

The integral cant panel 36 extending from the upper flange 14 forms a wedge-shaped structure to define a cant strip along the base of a parapet of the roof structure. The mounting strip 38 mates against the parapet 60 and is secured thereto using conventional fasteners, such as concrete nails. A membrane or other roofing materials 92 can then be installed on top of the insulation and cant strip, as seen in FIG. 2. A splice joint 40 may be provided at the ends of the edge closure to allow for lateral movement and extension of adjacent sections 10', 10" of the edge closure 10.

The edge closure 10 is further provided with vent means 30 for allowing moisture and gasses to be released from the roof assembly. In particular, the vent means 30 allow moisture and gasses which may accumulate during the installation and setting of lightweight insulation concrete or other insulative material. The release of gasses and moisture via the vent means serves to reduce the likelihood of premature roof failure. In a preferred embodiment, the vent means comprises a plurality of apertures 32 formed through the thickness of intermediate plate portion 16 at spaced intervals along a length thereof. The apertures may be in the form of circular holes or elongate slots.

It should be noted that the anchoring flange 12, intermediate flange portion 16, upper flange 14, cant panel 36, and mounting strip 38 are preferably formed as an integral unit from galvanized steel, steel, aluminum, plastic or other non-corrosive, durable materials. The integral unit may be formed by various forming and molding methods well known in the industry including bending, roll forming, extrusion molding, injection molding and vacuum molding.

Figure 3:
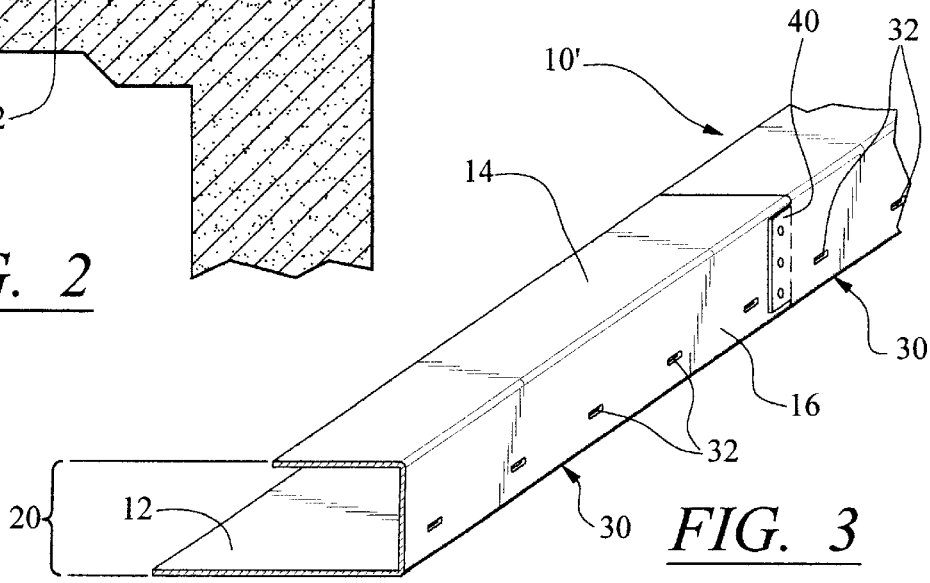
FIG. 3 is a partial perspective view of an alternative embodiment of the edge closure.

Referring to FIG. 3, an alternative embodiment of the edge closure 10 is shown and generally indicated as 10'. The edge closure 10' is intended for use as a perimeter or edge closure in areas which do not require a cant strip. Similar to the embodiment of FIGS. 1 and 2, the edge closure 10' is formed as an integral unit and includes an anchoring flange 12, an upper flange 14, and an intermediate plate 16 extending between the anchoring flange 12 and the upper flange 14. The anchoring flange 12 and upper flange 14 extend generally perpendicularly from the intermediate plate 16 in spaced, parallel relation to one another to form the gap or area or depth 20 therebetween. The gap 20 accommodates roof insulation or a lightweight insulative concrete layer 24 which is applied in covering relation to the underlying roof slab, as described above.

While the instant invention has been shown and described in accordance with preferred and practical embodiments thereof, it is recognized that departures may be made from the instant disclosure which, therefore, should not be limited except as set forth in the following claims as interpreted under the doctrine of equivalents.

What is claimed is:

1. An edge closure for installation to a roof structure of a building, wherein the roof structure includes insulation materials, said edge closure comprising:

an anchoring flange structured and disposed for attachment to the roof structure;

an upper flange positioned and disposed in parallel, spaced relation above said anchoring flange to define an area of depth therebetween for receipt of the insulation materials between said upper flange and said anchoring flange;

an intermediate portion including a flat plate extending vertically between said anchoring flange and said upper flange;

a cant panel angled upwardly from said upper flange to define a cant strip; and a mounting strip, extending upwardly from said cant panel, said mounting strip being structured and disposed for attachment to the roof structure.

2. The edge closure as recited in claim 1 wherein said plate of said intermediate portion is perpendicular to said anchoring flange.

3. The edge closure as recited in claim 2 wherein said cant panel is angled at an acute angle relative to said upper flange.

4. The edge closure as recited in claim 3 wherein said anchoring flange, said upper flange, said intermediate portion, said cant panel, and said mounting strip are formed as an integral unit from a single sheet of material.

5. The edge closure as recited in claim 4 wherein said single sheet of material is galvanized steel.

6. The edge closure as recited in claim 4 wherein said single sheet of material is steel.

7. The edge closure as recited in claim 4 wherein said single sheet of material is aluminum.

8. The edge closure as recited in claim 3 wherein said anchoring flange, said upper flange, said intermediate portion, said cant panel, and said mounting strip are formed as an integral unit.

9. The edge closure as recited in claim 8 wherein said integral unit is formed of plastic.

10. The edge closure as recited in claim 1 further comprising:

vent means formed in said intermediate portion and including a plurality of apertures provided at spaced intervals along said intermediate portion for venting moisture and gases from within said roof structure.

11. An edge closure for installation to a roof structure of a building, wherein the roof structure includes a slab, a parapet or vertical wall extending upwardly and generally perpendicular to the slab, and insulation materials applied in overlying relation to the slab, said edge closure comprising:

an integral one-piece unit comprising:

an anchoring flange structured and disposed for attachment to the slab of the roof structure;

an upper flange positioned and disposed in parallel, spaced relation above said anchoring flange to define an area of depth therebetween for receipt of the insulation materials between said upper flange and said anchoring flange;

an intermediate portion including a flat plate extending vertically between said anchoring flange and said upper flange;

a cant panel angled upwardly from said upper flange at an acute angle to define a cant strip; and a mounting strip extending upwardly from said cant panel, said mounting strip being structured and disposed for mating engagement and attachment to the parapet or vertical wall of the roof structure.

12. The edge closure as recited in claim 11 further comprising:

vent means formed in said intermediate portion and including a plurality of apertures formed at spaced intervals along said intermediate portion for venting moisture and gases from within said roof structure.

13. The edge closure as recited in claim 11 wherein said plate of said intermediate portion is perpendicular to said anchoring flange.

14. The edge closure as recited in claim 11 wherein said integral one-piece unit is formed from a single sheet of material.

15. The edge closure as recited in claim 14 wherein said single sheet of material is galvanized steel.

16. The edge closure as recited in claim 14 wherein said single sheet of material is steel.

17. The edge closure as recited in claim 14 wherein said single sheet of material is aluminum.

18. The edge closure as recited in claim 11 wherein said integral unit is formed of plastic.

* * * * *